United States Patent [19]

Wehner et al.

[11] 3,990,251

[45] Nov. 9, 1976

[54] EXCAVATION ROOF SUPPORT

[75] Inventors: Karl Heinz Wehner, Castrop-Rauxel; Günter Bell, Horneburg; Willy Watermann, Dortmund-Berghofen; Angelo Cassone, Herten, all of Germany

[73] Assignee: Klockner-Werke AG, Duisburg, Germany

[22] Filed: Nov. 14, 1975

[21] Appl. No.: 632,174

[30] Foreign Application Priority Data

Nov. 16, 1974 Germany ..... 2454511

[52] U.S. Cl. ..... 61/45 D; 248/357

[51] Int. Cl.[2] ..... E21D 15/44

[58] Field of Search ..... 61/45 D; 299/31, 33; 91/170 MP; 248/357

[56] References Cited

UNITED STATES PATENTS 3,811,288 5/1974 Wehner et al. ..... 61/45 D

FOREIGN PATENTS OR APPLICATIONS 1,290,507 3/1969 Germany ..... 299/32

154,515 10/1963 U.S.S.R. ..... 299/32

*Primary Examiner*—Dennis L. Taylor

*Attorney, Agent, or Firm*—Michael J. Striker

[57] ABSTRACT

An advancing excavation roof support has a base and a shield assembly above the base. The base has two base portions which are spaced from one another at its end which faces toward the face of the excavation, and a lifting member is mounted between the two base portions for pivoting about an axis. A hydraulic cylinder-and-piston unit extends between the base and the lifting member and pivots the latter about its pivoting axis between a retracted position in which the lifting member is out of contact with the excavation floor, and an extended position in which an engaging portion of the lifting member engages the excavation floor and is downwardly spaced from the base so that the one end of the base which faces the excavation face is elevated and digging thereof into the excavation floor is prevented. The lifting member may be either of box-shaped configuration with an open top, and in that case a transverse beam rigid with the base portions carries a downwardly extending cylinder-and-piston assembly engaging the lifting member intermediate the axis and the engaging portion thereof, or a single-acting lever mounted on a pivot in an upper region of the base, and in that event cylinder-and-piston assembly exerts a force on the lever in direction toward the excavation face.

11 Claims, 4 Drawing Figures

EXCAVATION ROOF SUPPORT

BACKGROUND OF THE INVENTION

The present invention relates to an excavation roof support, and more particularly to an advancing excavation roof support.

There are already known various types of excavation roof supports which, generally speaking, include a base, at least one shield extending above the base, and various arrangements for supporting the shield on the base and for changing the position of the shield relative to the base. The present invention will be illustrated and described as embodied in a particular type of an excavation roof support, but it will be appreciated that its utilization in other types of roof supports is equally feasible. In this type of roof support, the base has a shielding portion at its end facing away from the excavation face, the shielding portion being rigidly connected to this end of the base and extending upwardly therefrom. A shield is pivotally connected to the shielding portion in its upper region, and a pit prop extends between the base and the shield and serves the purpose of pivoting the shield relative to the base so as to accommodate the roof support to various seam thicknesses. The shield has a free end spaced from the base, and a roof-supporting cap is pivoted to the free end of the shield. An advancing arrangement is mounted on the base, and extends between the latter and a conveyor which is located between the base and the excavation face. Experience with this conventional type of a roof support has shown that excellent results are obtained so long as the floor underneath the base is relatively rigid. On the other hand, it has been found that, when the excavation floor is relatively soft or cloddy, the end of the base which is subjected to the highest forces, that is the end of the base which is closest to the excavation face, has the tendency to dig into and penetrate the excavation floor to a certain extent so that, when the roof support advances toward the receding excavation face, the forward end of the base damages, rips, or otherwise destroys the excavation floor. This is, of course, disadvantageous not only from the point of view of quality of the excavation, but also for the reason that it is necessary to utilize a much higher force for advancing the roof support than would otherwise be necessary if the end of the base which is closest to the excavation face did not dig into the excavation floor.

This problem has already been recognized, and has been proposed to eleviate or eliminate this problem in various ways. So, for instance, inasmuch as the roof support is not used in isolation, but rather in combination with a plurality of identical roof supports which are arranged in a row along the excavation face and which advance one after the other, one of the conventional ways of dealing with this problem is to mount lifting mechanisms on the neighboring roof supports, the lifting mechanisms of each two roof supports being used for lifting the forward end of the roof support base located between them. In this manner, the base which has dug into the excavation floor is lifted to a certain extent upon which the roof support is advanced either immediately, or only after placing supporting beams or other bolstering elements underneath the base. It will be appreciated that this conventional arrangement requires a rather substantial capital investment and laborious manipultion. Also, less than satisfactory results are achieved with this arrangement at the ends of the row of supports.

SUMMARY OF THE INVENTION

Accordingly, it is a general object of the present invention to avoid the disadvantages of the prior art.

More specifically, it is an object of the present invention to provide an excavation roof support which can be used on both relatively rigid and relatively soft excavation floors.

It is a further object of the present invention to provide an excavation roof support having a base the forward end of which can be elevated without the help of the neighboring roof supports.

It is a concomitant object of the present invention to provide a self-lifting excavation roof support which is simple in construction and reliable in operation.

It is yet another object of the present invention to provide an excavation roof support which does not require a high degree of skill for its operation.

In pursuance of these objects and others which will become apparent hereafter, one feature of the present invention resides, in a roof support for use in underground excavations, briefly stated, in a combination which comprises a base having one end closer to and another end farther away from the face of the excavation; a shield assembly connected to the other end and extending therefrom toward the excavation face above the base; means for advancing the roof support toward the excavation face as the latter recedes; and means for elevating the one end of the base prior to the advancement of the roof support to thereby prevent digging of the one end into the excavation floor, the elevating means including at least one lifting member mounted on the one end of the base for pivoting about an axis and having an engaging portion spaced from the axis, and means for applying a force to the lifting member for pivoting the same about the axis between a retracted position in which the lifting member is out of contact with the excavation floor, and an extended position in which the engaging portion engages the floor and is downwardly spaced from the one end of the base.

According to one currently preferred embodiment of the present invention, the base includes two base portions which are spaced from one another and extend from the other end of the base toward the excavation face, and a transverse beam extends between the two base portions and is rigid therewith. The lifting member is mounted between the two base portions downwardly of the transverse beam, and a cylinder-and-piston assembly is mounted on the transverse beam and engages the lifting member intermediate the axis of pivoting thereof and the engaging portion.

In the roof support of the present invention, it is merely necessary, in order to lift the base of the roof support which has previously dug into or sunk in the excavation floor, from the latter so as to make the roof support ready for the following advanement thereof toward the receding excavation face, to supply pressurized hydraulic medium to the above-mentioned cylinder-and-piston assembly. In this event, the hydraulic cylinder-and-piston unit engages the lifting member which, in turn, engages the excavation floor as it is pivoted about its axis, whereupon further pivoting of the lifting member results in lifting of the transverse beam and the base portions which are rigid therewith to such an extent, until the base portions are lifted sufficiently for the next following advancement of the roof support toward the excavation face.

In this currently preferred embodiment of the invention, the hydraulic cylinder-and-piston assembly is arranged approximately normal to the excavation floor. The lifting member may be of box-shaped configuration and have an open top and the edges thereof, and particularly the engaging portion, may be rounded. This is advantageous in that the absence of any relatively sharp edges from the lifting member assures that the lifting member will be able to easily slide over any obstructions which may be present at the excavation floor.

According to a further currently preferred embodiment of the present invention, it is proposed that a single-acting lever be arranged in the forward part of the base of the roof support, the lever being mounted in or above the upper region of the base for pivoting about an axis. In this event, the lifting force is exerted on the lever downwardly from the pivot axis in direction toward the excavation face. In this embodiment, the lifting force may be exerted by the advancing arrangement of the entire system.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DISCUSSION OF THE PREFERRED EMBODIMENTS

Figure 1:
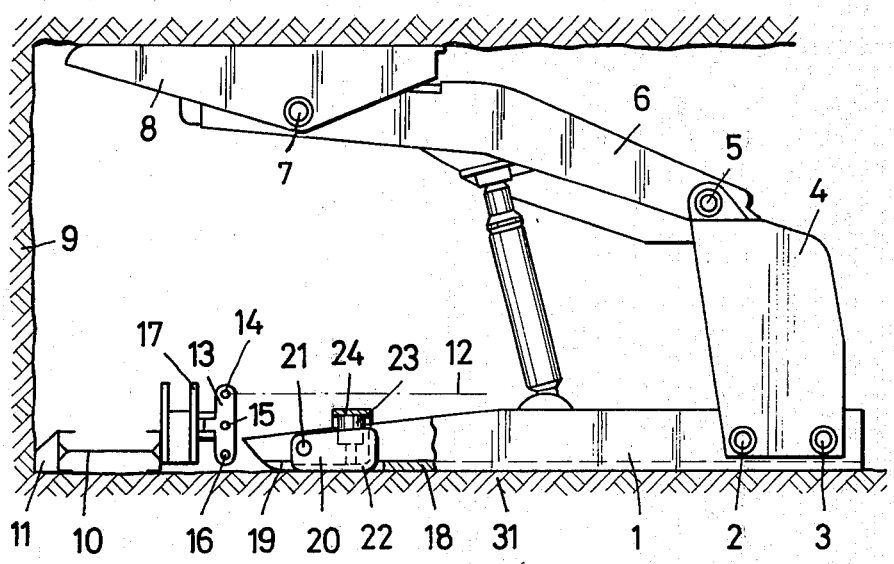
FIG. 1 is a somewhat diagrammatic side elevational view of a first embodiment of the present invention as untilized in a roof support, partly in section.

Referring now to the drawing in detail, and first to FIG. 1 thereof, it may be seen that a basically conventional roof support for use in underground excavations includes a base 1 which rests on the excavation floor 31. Two bolts 2 and 3 connect a shielding portion 4 to that end of the base 1 which is farther away from the face 9 of the excavation. A shield 6 is mounted on the shielding portion 4 by means of a pivot 5. A roof-engaging cap 8 is mounted at the free end of the shield 6 via a pivot 7. A conveyor 10 is arranged between the base 1 and the excavation face 9, and a ramp 11 is located between the conveyor 10 and the excavation face 9. It is to be understood that this particular type of the roof support has been used for illustration purposes only, the thus-far explained arrangement being entirely conventional, and that the present invention can also be utilized in other roof supports constructionally different from that illustrated.

A non-illustrated cutting device travels along the conveyor 10 and removes coal or other material to be excavated from the mine face 9. Thus, the mine face 9 recedes and the conveyor 10, on the one hand, and the roof support, on the other hand, must be advanced toward the receding excavation face 9. A conventional advancing arrangement is used for this purpose, the advancing arrangement having been assigned a reference numeral 12. In order to simplify FIG. 1, the advancing arrangement 12 has only been illustrated as a phantom line. A bracket 13 is connected to the conveyor 10, and is provided with openings 14, 15 and 16 to either one of which the advancing arrangement 12 can be connected. A sheet material member 17 connects the bracket 13 to the conveyor 10. The advancement of such a conveyor-roof support arrangement is also well known, so that it is sufficient to say that, when the conveyor 10 is advanced, the roof support is stationary and vice versa.

Figure 2:
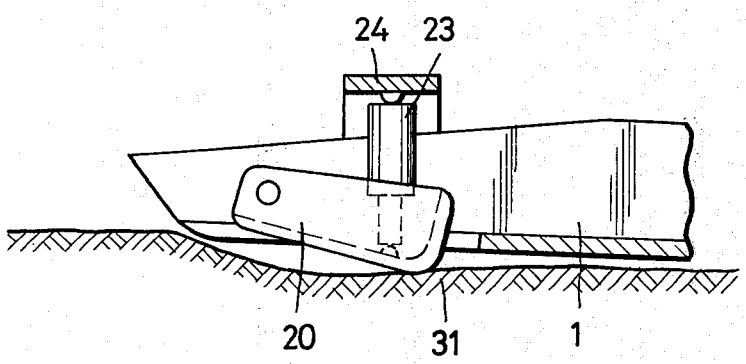
FIG. 2 is an enlarged sectional view of the front of the base illustrated in FIG. 1, with the lifting member of the present invention in its extended position.

Referring now more particularly to FIG. 2, it may be seen therein that the base 1 is formed with a recess 18 which extends from one end of the base 1 to its other end. The advancing arrangement 12, which is illustrated as a cylinder-and-piston unit, is located in the recess 18. The base 1 is further provided, at its end which is closer to the excavation face 9, with a cutout 19. A lifting member 20 is arranged at this end of the base 1, and is mounted on a pivot 21 for pivoting about its axis. A hydraulic cylinder-and-piston arrangement 23 is mounted on a transverse beam 24 which is rigid with the base 1 and extends between two base portions thereof. The lifting member 20 is generally box-shaped and has an open top and a bottom wall 22, and the hydraulic cylinder-and-piston assembly 23 engages the bottom wall 22 of the lifting member 20 with spacing from the pivot 21.

The operation of the lifting member of the present invention will now be discussed with particularly reference to FIGS. 1 and 2 of the drawing.

The lifting member 20 is illustrated in FIG. 1 in its retracted position, that is in its position in which it is substantially out of contact with the mine floor 31. This position is assumed by the lifting member 20 when the excavation floor 31 is sufficiently rigid to prevent sinking of the base 1 thereinto. On the other hand, this position is also assumed by the lifting member 20 when the excavation floor 31 is soft or cloddy, prior to the advancement of the base 1 toward the excavation face 9. However, when the roof support, including its base 1, is to be advanced, and the excavation floor 31 is soft or cloddy, a pressurized hydraulic medium is delivered to the cylinder-and-piston assembly 23, whereby the lifting member 20 is pivoted into its position illustrated in FIG. 2 so that a rounded engaging portion of the lifting member 20 first engages the excavation floor 31 and then the further rotation of the lifting member 20 results in lifting of the transverse beam 24 and thus of the base 1 which is rigid therewith. In this manner, the base 1 will be advanced over the excavation floor 31 without digging into it to any appreciable extent.

Figure 3:
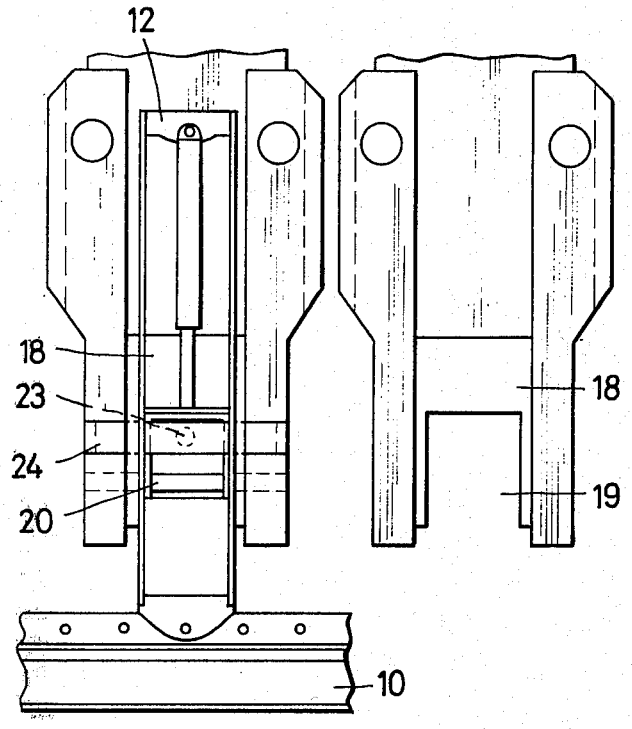
FIG. 3 is a top plan view of the base of the roof support assembly illustrated in FIG. 1.

In this embodiment of the present invention, which is illustrated in FIGS. 1 through 3, the hydraulic cylinder-and-piston unit extends from the transverse beam 24 approximately normal to the excavation floor 31. The lifting member 20 is generally box-shaped and has an open tap, and the edges thereof are rounded. Thus, when the base 1 is advanced, the lifting member 20 will slide over any possible obstructions in its way without encountering any substantial resistance to its movement.

Figure 4:
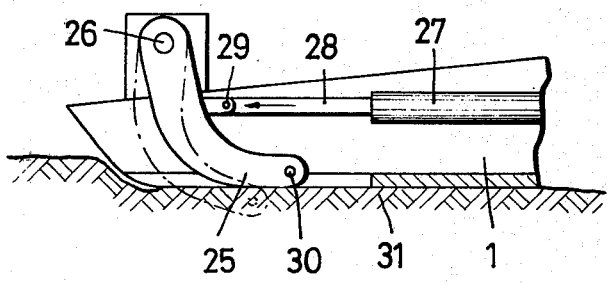
FIG. 4 is a view similar to FIG. 2 but illustrating a different embodiment of the present invention in both its retracted and extended positions.

FIG. 4 illustrates a slightly different embodiment of the present invention, in which a single-acting lever 25 of arcuate configuration is arranged in the forward part of the base 1, that is that part which is closer to the mine face 9 than the rest of the base 1. A pivot 26 is arranged upwardly of the base 1, supported on projections thereof, and the lever 25 is mounted on the pivot 26 for pivoting about the same. A hydraulic cylinder-and-piston assembly 27, 28 extends in the longitudinal direction of the base 1, that is substantially normal to the excavation face 9, and the cylinder 27 is connected, in a non-illustrated conventional manner, to the advancing arrangement 12. On the other hand, the piston rod 28 is connected to the lever 25 at a pivot 29 which is located downwardly of the pivot 26 about which the lever 25 rotates. It may be desirable or necessary to arrest the arcuate lever 25 in at least some of its positions with respect to the base 1, so that an opening 30 is provided at the free end of the lever 25 and a bolt or a similar arresting device may extend therethrough when it is necessary to arrest the lever 25.

The lever 25 is illustrated in FIG. 4 in full lines in its retracted position, and in phantom lines in its extended position. In order to prevent sinking of the base 1 in the excavation floor 31 during the advancment thereof, the hydraulic cylinder-and-piston assembly 27, 28 is supplied with a pressurized hydraulic medium during the advancement of the base 1. In this manner, a force component which is substantially normal to the excavation floor 31 comes into existence during advancment of the base 1, which component tends to lift the base 1 at least to such an extent that digging of the base 1 into the excavation floor during advancement of the latter is prevented.

It will be understood that each of the elements described above, or two or more together, may also find a useful application in other types of constructions differing from the types described above. So, for instance, the construction of the roof support may be different from that illustrated. Also, pneumatic rather than hydraulic cylinder-and-piston units may be used, or the advancement of the roof support and pivoting of the lifting member may be achieved differently.

While the invention has been illustrated and described as embodied in an excavation roof support, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a roof support for use in underground excavations, a combination comprising a base having one end closer to and another end farther away from the face of the excavation; a shield assembly connected to said other end and extending therefrom toward the excavation face above said base; means for advancing said roof support toward the excavation face as the latter recedes; and means for elevating said one end of said base prior to the advancement of said roof support to thereby prevent digging of said one end into the excavation floor, said elevating means including at least one lifting member mounted on said one end of said base for pivoting about an axis and having an engaging portion spaced from said axis, and means for applying a force to said lifting member for pivoting the same about said axis between a retracted position in which said lifting member is out of contact with the excavation floor, and an extended position in which said engaging portion engages the floor and is downwardly spaced from said one end of said base.

2. A combination as defined in claim 1, wherein said advancing means includes a conveyor between said one end of said base and the excavation face, and at least one hydraulic cylinder-and-piston unit extending between and connected to said base and to said conveyor, respectively and operative for changing the distance between the former and the latter.

3. A combination as defined in claim 1, wherein said shield assembly includes a shield pivoted at said other end of said base and having a free end, and a roofengaging cap pivoted to said free end of said shield.

4. A combination as defined in claim 3, wherein said other end portion of said base has a shielding portion extending upwardly from said base; and wherein said shield is pivoted at said shielding portion.

5. A combination as defined in claim 3, wherein said shield assembly further includes a pit prop extending between said base and said shield and operative for pivoting said shield with respect to said base.

6. A combination as defined in claim 1, wherein said base includes two base portions spaced from one another and extending from said other end of said base toward the excavation face, and a transverse beam extending between and rigid with said base portions; wherein said lifting member is mounted between said base portions downwardly of said transverse beam; and wherein said applying means includes a cylinder-and-piston assembly mounted on said transverse beam and in engagement with said lifting member.

7. A combination as defined in claim 6, wherein said cylinder-and-piston assembly is hydraulically operated; and wherein said assembly extends substantially normal to the excavation floor.

8. A combination as defined in claim 1, wherein said applying means engages said lifting member intermediate said axis and said engaging portion.

9. A combination as defined in claim 1, wherein said lifting member has substantially box-shaped configuration and is upwardly open; and wherein said engaging portion of said lifting member is rounded.

10. A combination as defined in claim 1, wherein said lifting member is a single-acting lever pivoted on a pivot supported in an upper region of said one end of said base; and wherein said applying means engages said lever downwardly of said pivot and exerts thereon a force directed toward the excavation face.

11. A combination as defined in claim 1, and further comprising means for arresting said lifting member in at least one position thereof.

* * * * *